US011565436B2

(12) United States Patent
McCracken et al.

(10) Patent No.: US 11,565,436 B2
(45) Date of Patent: Jan. 31, 2023

(54) METHODS OF MANUFACTURING KNIFE HOLDERS OF CUTTING WHEELS

(71) Applicant: URSCHEL LABORATORIES INC., Chesterton, IN (US)

(72) Inventors: Anthony A. McCracken, Dyer, IN (US); Michael Scot Jacko, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 104 days.

(21) Appl. No.: 16/827,073

(22) Filed: Mar. 23, 2020

(65) Prior Publication Data

US 2020/0223085 A1 Jul. 16, 2020

Related U.S. Application Data

(62) Division of application No. 15/090,962, filed on Apr. 5, 2016, now Pat. No. 10,611,042.

(60) Provisional application No. 62/143,380, filed on Apr. 6, 2015.

(51) Int. Cl.

| | |
|---|---|
| ***B26D 1/29*** | (2006.01) |
| ***B26D 7/01*** | (2006.01) |
| ***B26D 7/26*** | (2006.01) |
| ***B26D 7/06*** | (2006.01) |

(52) U.S. Cl.

CPC ..... *B26D 1/29* (2013.01); *B26D 7/01* (2013.01); *B26D 7/2614* (2013.01); *B26D 7/0625* (2013.01)

(58) Field of Classification Search

CPC . B26D 1/29; B26D 1/295; B26D 7/26; B26D 7/2614; B26D 7/2621; B26D 2007/2607; B26D 2003/285–288

USPC ..... 83/402–408, 858

See application file for complete search history.

(56) References Cited

U.S. PATENT DOCUMENTS

| | | | | |
|---|---|---|---|---|
| 118,235 A * | 8/1871 | Harnish et al. | ..... | B26D 1/29 83/356.3 |
| 1,489,419 A * | 4/1924 | Beechlyn | ..... | B26B 9/02 30/348 |
| 1,952,136 A * | 3/1934 | Mueller | ..... | B26D 1/0006 83/136 |
| 3,035,344 A * | 5/1962 | Brown | ..... | B26B 9/02 30/115 |

(Continued)

*Primary Examiner* — Kenneth E Peterson
*Assistant Examiner* — Richard D Crosby, Jr.
(74) *Attorney, Agent, or Firm* — Hartman Global IP Law; Gary M. Hartman; Domenica N. S. Hartman

(57) ABSTRACT

Cutting wheels equipped with knife assemblies suitable for performing size reduction operations on products, methods of operating cutting wheels, knife holders for such knife assemblies, methods of manufacturing knife holders, and slicing machines capable of utilizing such cutting wheels. The knife assemblies each have a leading edge that faces a direction of rotation of the cutting wheel, a trailing edge oppositely disposed from the leading edge, and a cutting edge on the leading edge. Each knife assembly further has a knife holder having a first surface that faces the products advanced toward the cutting wheel in a feed direction and a registration surface formed in the first surface. The registration surface is defined by at least a first recessed planar surface that is recessed a distance relative to the first surface and defines with the first surface at least a first step therebetween.

13 Claims, 11 Drawing Sheets

(56) References Cited

U.S. PATENT DOCUMENTS 3,516,312 A * 6/1970 Nordberg ..... A21C 11/16 83/675
3,623,525 A * 11/1971 Kieves ..... B26D 3/225 83/663
3,989,196 A * 11/1976 Urschel ..... B02C 13/282 241/27
4,038,892 A * 8/1977 Popeil ..... B26D 7/01 D7/381
4,187,891 A * 2/1980 Weill ..... B23P 6/00 144/162.1
4,206,671 A * 6/1980 Hoehn ..... B26D 3/22 83/410.8
4,212,431 A * 7/1980 Doyel ..... B26D 3/283 83/167
4,215,604 A * 8/1980 Blaimschein ..... B23C 3/08 82/106
4,523,503 A * 6/1985 Julian ..... B26D 1/03 83/403
5,095,875 A * 3/1992 Morris ..... B26D 1/0006 83/403
5,129,437 A * 7/1992 Nettles ..... B27L 11/005 144/162.1
5,191,819 A * 3/1993 Hoshi ..... B26D 1/035 83/349
5,404,777 A * 4/1995 Skaar ..... B26D 1/0006 83/676
5,819,628 A * 10/1998 Cogan ..... B26D 7/2614 83/698.11
5,992,284 A * 11/1999 Bucks ..... B26D 1/0006 83/663
6,148,702 A * 11/2000 Bucks ..... B26D 1/0006 83/110
6,244,150 B1 * 6/2001 Holcomb ..... A47J 43/25 83/858
6,536,691 B2 * 3/2003 Prewitt ..... B26D 1/02 241/86.1
6,792,841 B2 * 9/2004 Bucks ..... B26D 1/0006 83/418
7,146,737 B2 * 12/2006 Boerner ..... A47J 43/25 83/858
7,178,440 B2 * 2/2007 Bucks ..... B26D 1/29 83/663
7,270,040 B2 * 9/2007 King ..... B26D 7/0691 83/403
7,721,637 B2 * 5/2010 Bucks ..... B26D 1/0006 83/663
8,714,068 B2 * 5/2014 Ornelaz, Jr. ..... B26D 7/2614 83/403
8,839,702 B2 * 9/2014 Bagley ..... B26D 3/283 83/435.11
9,592,618 B2 * 3/2017 Reis ..... A23L 19/18
9,764,491 B2 * 9/2017 Martin ..... B26D 7/0691
10,611,042 B2 * 4/2020 McCracken ..... B26D 7/2614
10,807,263 B2 * 10/2020 Busch ..... B26D 7/2614
11,173,622 B2 * 11/2021 Barber ..... B26D 7/2614
2004/0079211 A1 * 4/2004 Walker ..... B26D 3/22 83/343
2005/0166736 A1 * 8/2005 Gass ..... B23D 45/067 83/477.2
2011/0154998 A1 * 6/2011 Wong ..... B26D 7/01 D7/381
2013/0087032 A1 * 4/2013 Walker ..... B26D 5/20 83/402
2014/0230620 A1 * 8/2014 Bucks ..... B26D 7/00 83/403
2014/0345434 A1 * 11/2014 Scattolin ..... B26D 1/0006 83/676
2016/0031105 A1 * 2/2016 Koebke ..... B26D 1/015 83/36
2016/0067877 A1 * 3/2016 Cogan ..... B26D 7/2614 83/13
2017/0225348 A1 * 8/2017 Jacko ..... B26D 7/08

* cited by examiner

FIG. 6
(PRIOR ART)
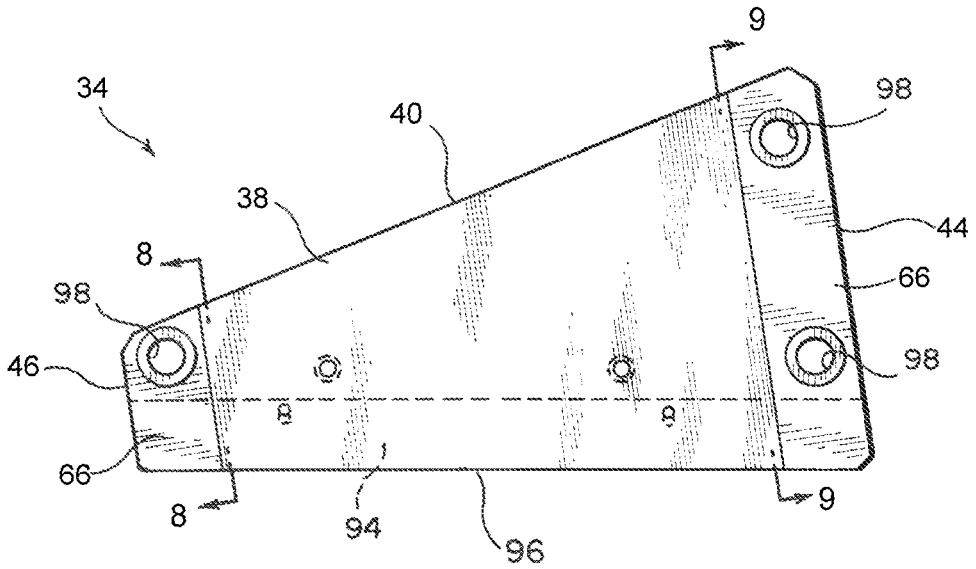
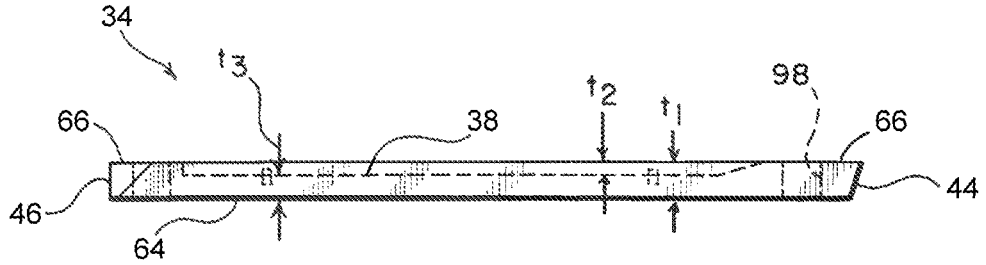
FIG. 7
(PRIOR ART)
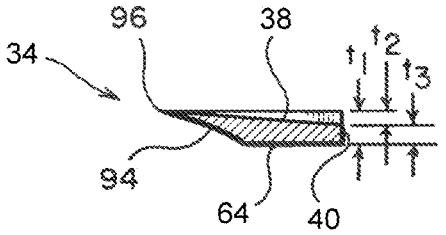
FIG. 8
(PRIOR ART)
FIG. 9
(PRIOR ART)
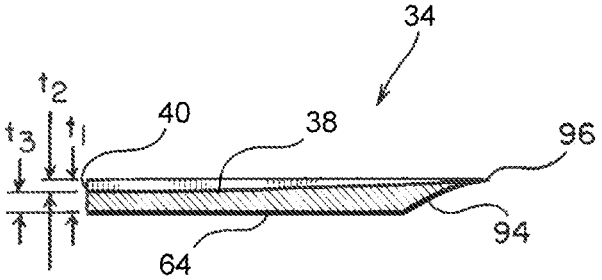

METHODS OF MANUFACTURING KNIFE HOLDERS OF CUTTING WHEELS

CROSS REFERENCE TO RELATED APPLICATIONS

This is a division patent application of U.S. patent application Ser. No. 15/090,962, filed Apr. 5, 2016, now U.S. Pat. No. 10,611,042, which claims the benefit of U.S. Provisional Application No. 62/143,380, filed Apr. 6, 2015. The contents of these prior applications are incorporated herein by reference.

BACKGROUND OF THE INVENTION

The present invention generally relates to methods and equipment for performing size reduction operations on products, including but not limited to food products.

Various types of equipment are known for reducing the size of products, for example, slicing, strip-cutting, dicing, shredding, and/or granulating food products. Certain types of equipment are sometimes referred to as transverse slicers that, as schematically represented in FIGS. 1 and 2, utilize a rotating cutting wheel 10 having radially-extending cutting knives or blades 12 that define a cutting plane through which products 16 are advanced, for example, on a conveyor belt 18, toward the wheel 10 in a feed direction. The cutting wheel 10 typically rotates about a horizontal axis 14 to define a vertical cutting plane. A particular cutting wheel disclosed in U.S. Pat. Nos. 5,992,284 and 6,792,841 is commercially known as the Microslice®, manufactured by Urschel Laboratories, and utilized in a variety of size-reduction machines offered by Urschel Laboratories. The blades of the Microslice® cutting wheel transversely slice products advanced through the cutting plane in a rapid manner to enable high volume production of product slices 20, for example, food slices, of substantially uniform thickness.

FIG. 3 depicts certain aspects of cutting wheels of the type disclosed in U.S. Pat. Nos. 5,992,284 and 6,792,841. Similar to the cutting wheel 10 of FIGS. 1 and 2, FIG. 3 represents a cutting wheel 22 having a rim portion 24 surrounding a hub portion 26, which together support truncated triangular-shaped cutting knife assemblies 28 by means of fasteners 30 so that each knife assembly 28 spans the radial distance between the rim and hub portions 24 and 26 of the cutting wheel 22. Each knife assembly 28 includes a knife blade 32 (shown with hidden lines) carried by a knife holder 34. As evident from FIG. 3, each knife holder 34 has a truncated triangular shape such that the holders 34 have wider and narrower ends, with their wider ends 44 connected to the rim portion 24 and their narrower ends 46 connected to the hub portion 26. Only the cutting edges 36 of the blades 32 are visible in FIG. 3, as the view is that of the side of the cutting wheel 22 facing products as they approach the wheel 22, with the rotation of the wheel 22 indicated by the arrow. Each knife holder 34 defines a registration surface 38 (also referred to as a gauging surface) against which products abut and register during slicing thereof. Each registration surface 38 terminates at a trailing edge 40 that is oppositely-disposed from the cutting edge 36 of the same knife assembly 28, faces the cutting edge 36 of the next adjacent (trailing) knife assembly 28, and cooperates with the cutting edge 36 of the trailing knife assembly 28 to define a gate 42 therebetween. The registration surface 38 and trailing edge 40 of each knife assembly 28 are offset from the cutting edge 36 of the trailing knife assembly 28 in the feed direction (perpendicular to the cutting plane of the wheel 22), such that the gate 42 therebetween defines a slice thickness gap that determines the thickness of a slice produced by the trailing knife assembly 28.

FIGS. 4 and 5 depict views of a knife assembly 28 of the type shown in FIG. 3, and FIGS. 6 through 9 depict various views of the knife holder 34 of the knife assembly 28. The knife holder 34 is generally planar, its trailing edge 40 is relatively blunt, and its oppositely-disposed leading edge 96 has a beveled surface 94. Other than the beveled surface 94 and the registration surface 38 (recessed as discussed below), the holder 34 has a uniform thickness, $t_1$ between oppositely-disposed surfaces 64 and 66 thereof (FIGS. 7 through 9). The knife holder 34 includes fastener receiving apertures 98 through which appropriate fasteners may be received for securing the assembly 28 to the rim and hub portions 24 and 26 of the cutting wheel 22. A knife retainer or clamp 100 is provided, having fastener-receiving apertures 102 through which fasteners 104 extend for assembling the knife clamp 100 to the surface 64 of the knife holder 34 opposite the registration surface 38 and therefore facing away from products approaching the cutting wheel 22. The knife blade 32 is mounted on the beveled surface 94 of the knife holder 34 and secured by the knife clamp 100 and fasteners 104, which are received in threaded apertures 110 in the knife holder 34. The blade 32 preferably further includes apertures 112 that can be aligned with studs 114 on the knife holder 34 to accurately locate the blade 32 on the knife holder 34 and prevent movement of the blade 32 relative to the knife holder 34 after the knife clamp 100 has been secured on the knife holder 34 by the fasteners 104, as illustrated in FIG. 5. The knife clamp 100 may include bores 116 that accommodate the studs 114 and may also engage the studs 114 for alignment and securing purposes.

The registration surface 38 of the knife holder 34 is visible in FIGS. 6 through 9. Relative to the surface 66 at the ends 44 and 46 of the holder 34, the registration surface 38 is recessed in the holder 34 by machining or forming the holder 34 to slope progressively from the leading edge 96 of the knife holder 34 toward its trailing edge 40. The knife holder 34, as noted previously, includes a relatively wider end 44 and a relatively narrower end 46. In order to obtain a uniform slice thickness gap at the gate 42 (FIG. 3) adjacent the trailing edge 40 that will yield slices of uniform thickness produced by the following knife assembly 28, the thickness ($t_3$) of the trailing edge 40 where it intersects the registration surface 38 must be uniform between the wider and narrower ends 44 and 46 of the holder 34. Therefore, the registration surface 38 tapers from the leading edge 96 toward the trailing edge 40 so that its depth ($t_2$) is uniform at its intersection with the trailing edge 40 between the wider and narrower ends 44 and 46 of the holder 34 (FIG. 7). Consequently, the slope of the registration surface 38 must progressively increase from the wider end 44 (FIG. 9) toward the narrower end 46 (FIG. 8) due to the shorter distance that the slope traverses. As a result, the registration surface 38 does not lie in a flat plane, but instead is a twisted or curved surface whose curvature is important for proper and stable registration of products during the slicing operation. A technique for generating the progressively increasing slope of the registration surface 38 is to fixture the knife holder 34 so that a twist is induced in the holder 34 prior to machining the holder 34 to form the registration surface 38. The degree of twist is carefully established and maintained during machining of the holder 34 so that when the holder 34 is released from the fixture, the slope of the registration surface 38 progressively increases corresponding to the degree of twist during machining.

As shown in FIG. 10, unsliced products 48 are advanced on a conveyor belt 50 toward the wheel 22 in a feed direction. The products 48 are conveyed in a manner such that each product 48 is individually supported in a zone between a terminus of the conveyor 50 (the region of the conveyor 50 where the food product 48 separates from the conveyor 50 as it engages the cutting wheel 22). Within this zone, each product 48 is sliced by the blades 32 of the cutting wheel 22 while supported by a supporting surface 54, represented in FIG. 10 as being defined by an "apron" (or shear edge) member 52 that has a shear edge 56 at which the supporting surface 54 terminates. The aforementioned slice thickness gap defined by the axial offset between the registration surface 38 at the trailing edge 40 of one knife assembly and the cutting edge 36 of the blade 32 of the trailing knife assembly 28 is evident from FIG. 10, as is the uniform thickness of a slice 58 produced by the trailing knife assembly 28. As disclosed in U.S. Pat. No. 6,792,841, the apron member 52 promotes the ability with which the cutting wheel 22 is able to precisely and uniformly slice round products, in part as a result of its supporting surface 54 sloping downwardly away from the conveyor 50. It is believed that the downward-sloping supporting surface 54 enables gravity to assist in moving the products 48 toward the knife assemblies 28 and to maintain engagement between the food products 48 and the registration surfaces 38 of the assemblies 28 as the food products 48 leave the conveyor 50. The food products 48 are initially supported by the terminal end of the conveyor 50 and then progressively supported by the supporting surface 54 of the apron member 52 while the food product 48 moves downwardly toward the shear edge 56.

Refinements to the radial cutting blades of slicing machines of the type described above have enabled production of precise, thin, uniform-thickness slices of various products. However, certain challenges are encountered when larger cutting wheels are required for cutting relatively large products, for example, cabbages, lettuce, potatoes, and meat products exceeding about 10 cm. For example, slicing of large products requires a more positive registration of the product against the registration surface 38 of each knife assembly 28 because the linear speed at the outermost radial extent of a larger wheel 22 is relatively greater and the product plane face (the planar surface generated on the product once it is sliced) will need a larger registration surface 38 in order to maintain a high degree of precise slice thickness. Furthermore, the rate at which the slope of the registration surface 38 progressively increases is different for knife holders 34 sized for use in wheels 22 of different diameters, and the machining or forming of the registration surfaces 38 and their progressively increasing slopes incur manufacturing costs.

BRIEF DESCRIPTION OF THE INVENTION

The present invention provides cutting wheels equipped with knife assemblies suitable for performing size reduction operations on products, including but not limited to food products, and further provides methods of operating such cutting wheels, knife holders suitable for such knife assemblies, methods of manufacturing such knife holders, and slicing machines capable of utilizing such cutting wheels.

According to one aspect of the invention, a rotatable cutting wheel includes a hub portion, a rim portion surrounding the hub portion, and a plurality of knife assemblies each having a leading edge facing a direction of rotation of the cutting wheel and extending between the hub and rim portions, a trailing edge oppositely disposed from the leading edge and extending between the hub and rim portions, and a cutting edge on the leading edge. Each knife assembly further has a knife holder having a first surface that faces the products advanced toward the cutting wheel in a feed direction and a registration surface formed in the first surface. The trailing edge intersects the registration surface and defines a gate with the cutting edge of a next adjacent knife assembly located in a direction opposite the direction of rotation of the cutting wheel. The gate is substantially constant and determines a thickness of the slices of the product produced by the cutting wheel. The registration surface is defined by at least a first recessed planar surface that is recessed a distance relative to the first surface and defines with the first surface at least a first step therebetween.

Other aspects of the invention include a knife holder comprising the elements described above, slicing machines capable of utilizing a cutting wheel comprising the elements described above, and methods of operating such a cutting wheel to cut slices from products as the products are advanced towards the cutting wheel in the feed direction.

Yet another aspect of the invention is a method of manufacturing the knife holder that entails machining the first surface of the knife holder to form the first recessed planar surface and the registration surface formed thereby, wherein the knife holder is not twisted during the machining of the first recessed planar surface.

Another aspect of the invention is a slicing machine capable of utilizing a cutting wheel comprising the elements described above. The slicing machine includes a cutting wheel comprising a hub portion, a rim portion circumscribing the hub portion so as to define an annular space therebetween, and knife assemblies extending between the hub and rim portions, removably attached to the hub and rim portions, and lying in a cutting plane of the cutting wheel. The slicing machine further includes means for stabilizing a product being fed through the cutting wheel in a feed direction transverse to the cutting plane. The stabilizing means comprises a shear edge against which a slicing action of each knife assembly occurs and a supporting surface that supports the product while the product is being sliced by the knife assemblies. The supporting surface comprises a serrated pattern that promotes the ability of the stabilizing means to grip and stabilize each of the products, maintain an orientation of the product while the product is being sliced by the knife assemblies, and maintain a slicing plane of the product relative to the cutting plane of the cutting wheel.

Technical effects of the various aspects described above preferably include the ability to produce precise, thin, uniform-thickness slices of various products, including relatively large products (e.g., food products exceeding about 10 cm in cross-section), by promoting a positive registration of such products against the registration surface of each knife assembly, and the ability to make use of a registration surface that is not curved and can therefore be manufactured without the requirement for inducing a twist during the machining of the registration surface.

Other aspects and advantages of this invention will be further appreciated from the following detailed description.

BRIEF DESCRIPTION OF THE DRAWINGS

FIGS. 6 and 7 respectively show plan and edge views of a knife holder of the knife assembly of FIGS. 4 and 5.

FIGS. 8 and 9 are section views taken along lines 8-8 and 9-9, respectively, in FIG. 6.

DETAILED DESCRIPTION OF THE INVENTION

Figure 1:
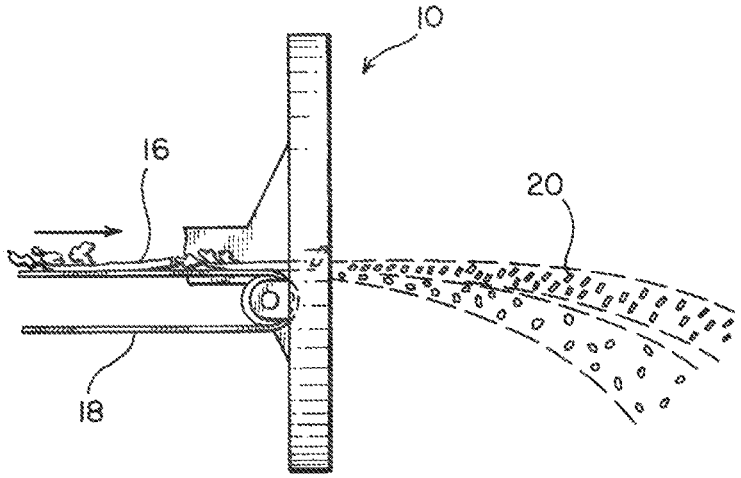
FIG. 1 (PRIOR ART)
FIGS. 1 and 2 show side and perspective views of a cutting wheel for slicing products and equipment for delivering the products to the cutting wheel.
Figure 2:
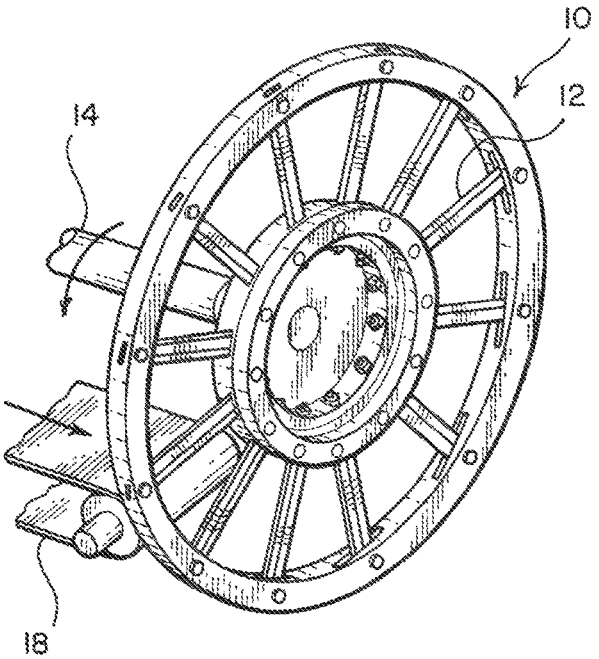
FIG. 2 (PRIOR ART)
Figure 3:
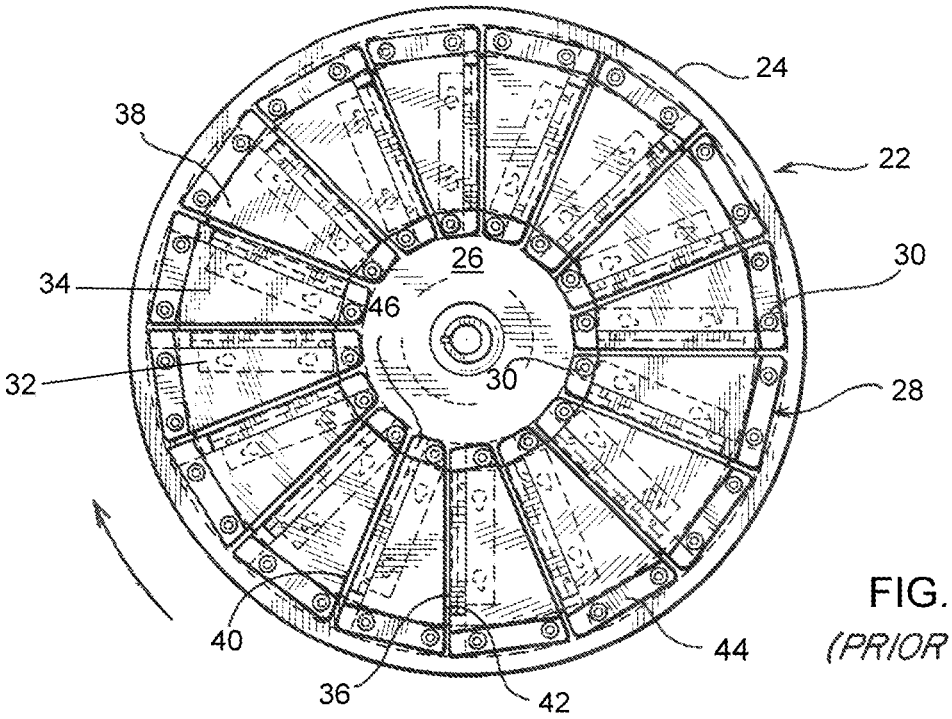
FIG. 3 (PRIOR ART)
FIG. 3 is an elevation view of a cutting wheel of a type known in the art.
Figure 10:
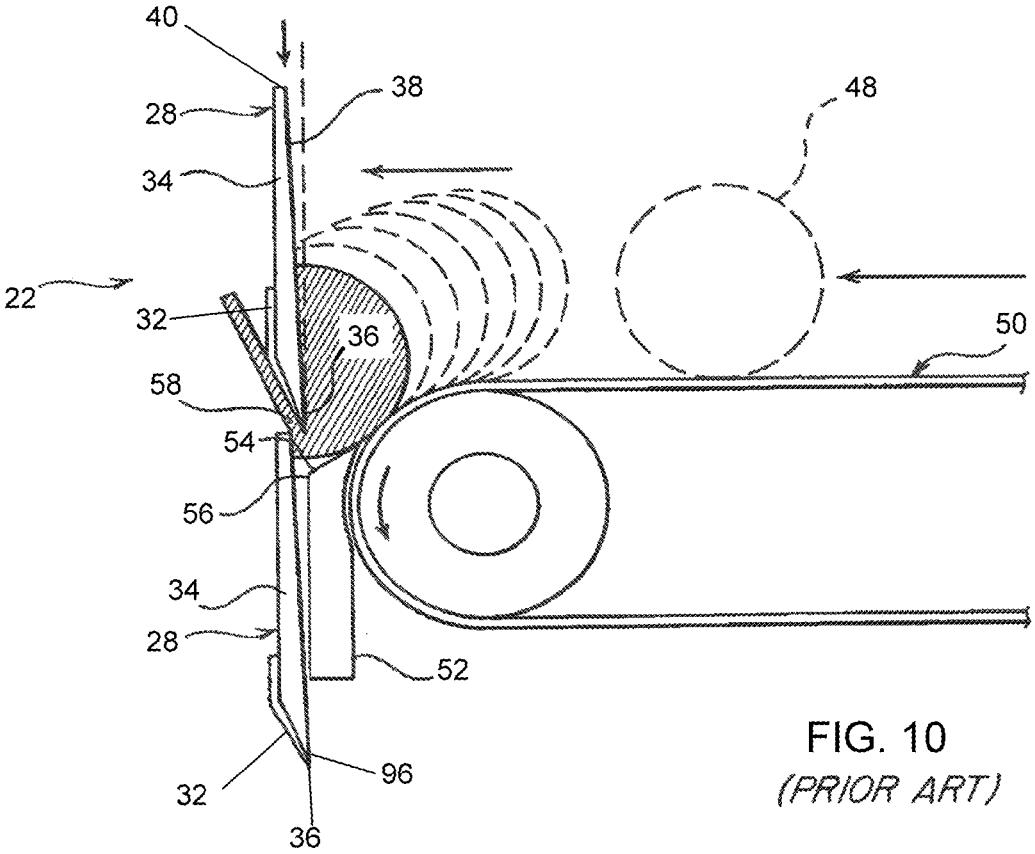
FIG. 10 (PRIOR ART)
FIG. 10 is a side elevation view showing a product undergoing slicing by the cutting wheel of FIG. 3.
Figure 4:
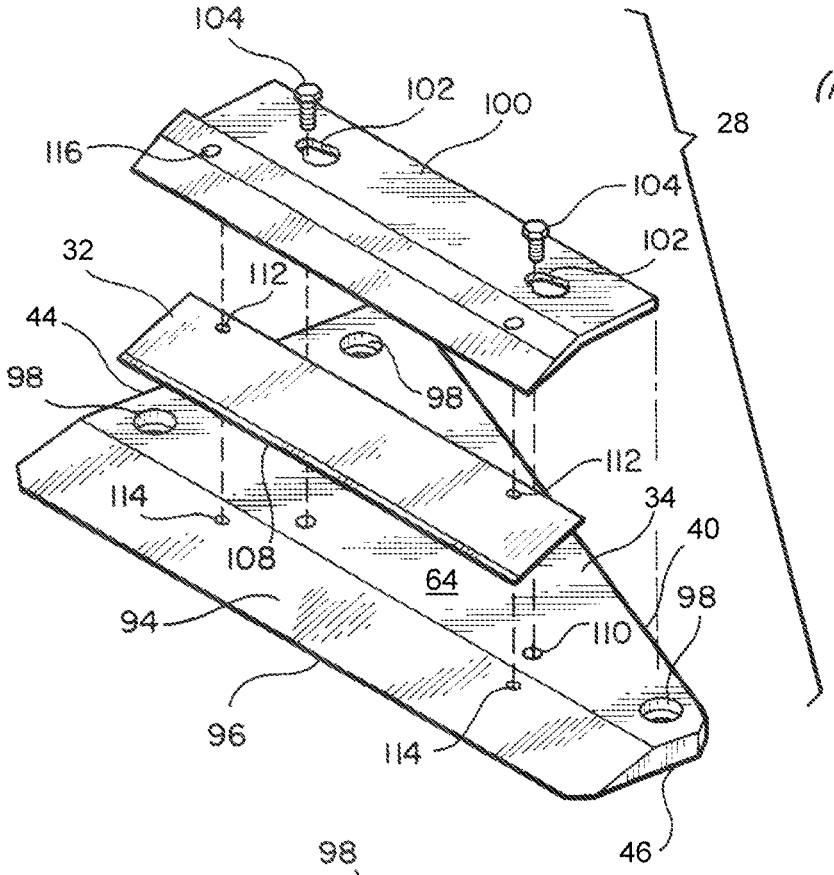
FIG. 4 (PRIOR ART)
FIGS. 4 and 5 respectively show perspective views of a disassembled and assembled knife assembly of FIG. 3.
Figure 5:
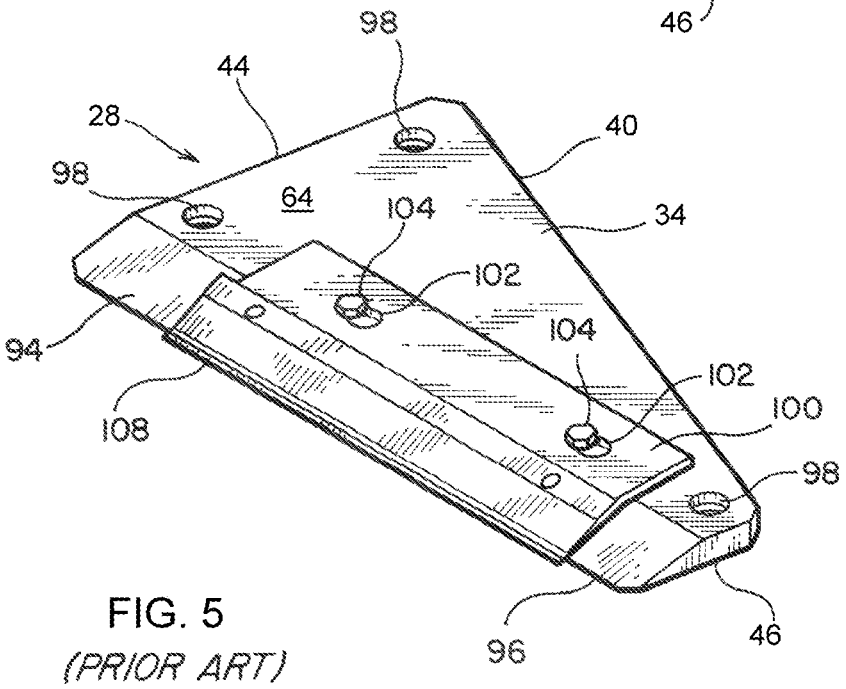
FIG. 5 (PRIOR ART)
Figure 11:
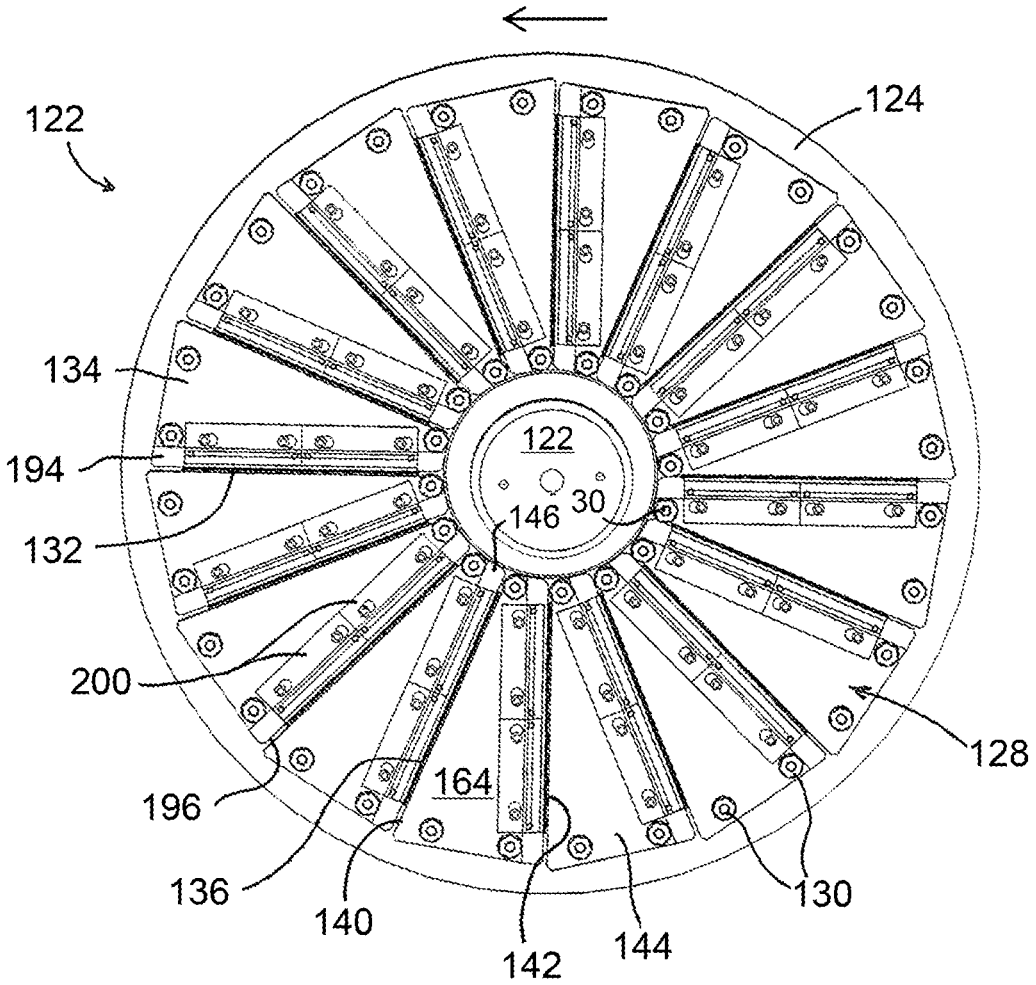
FIG. 11 is an elevation view of a cutting wheel with knife assemblies in accordance with a nonlimiting embodiment of the invention, wherein the knife assemblies comprise knife holders.
Figure 12:
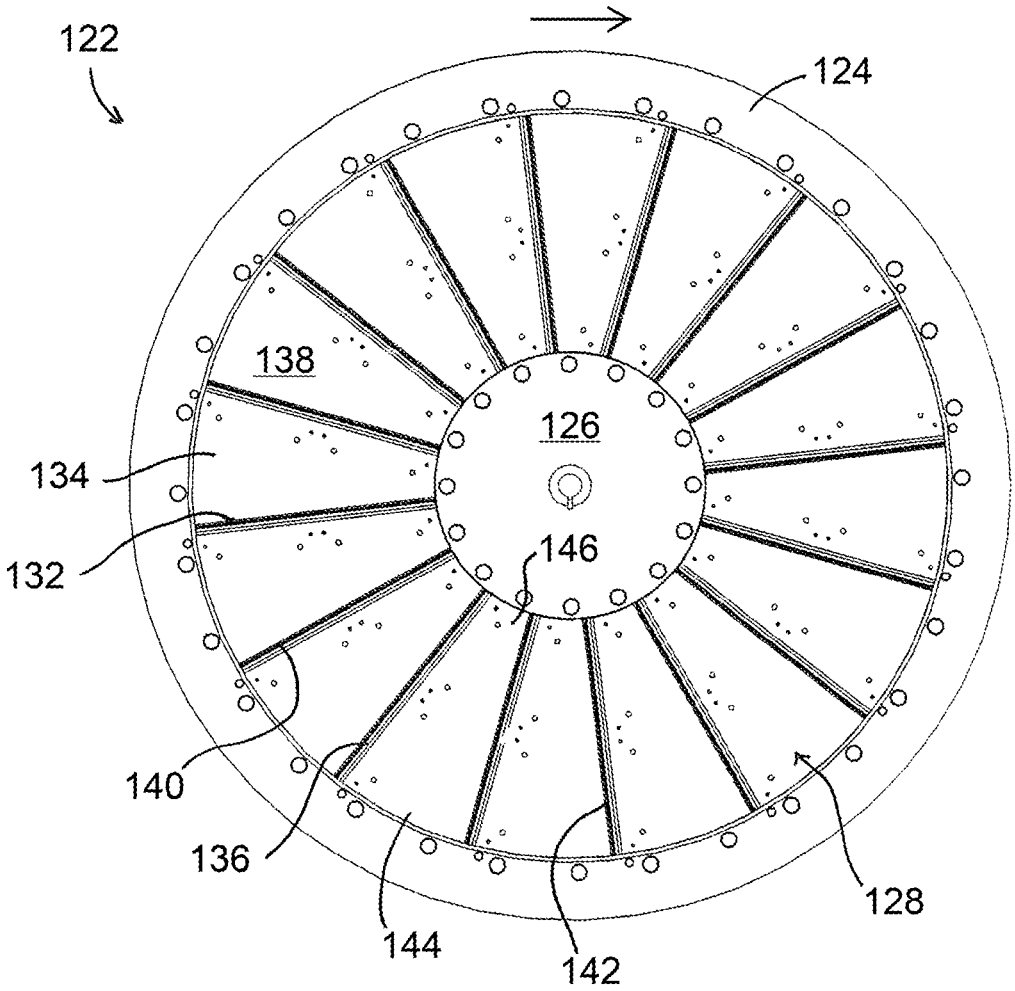
FIG. 12 is an opposite elevation view of the cutting wheel of FIG. 11, wherein registration surfaces of the knife assemblies are visible.
Figure 13:
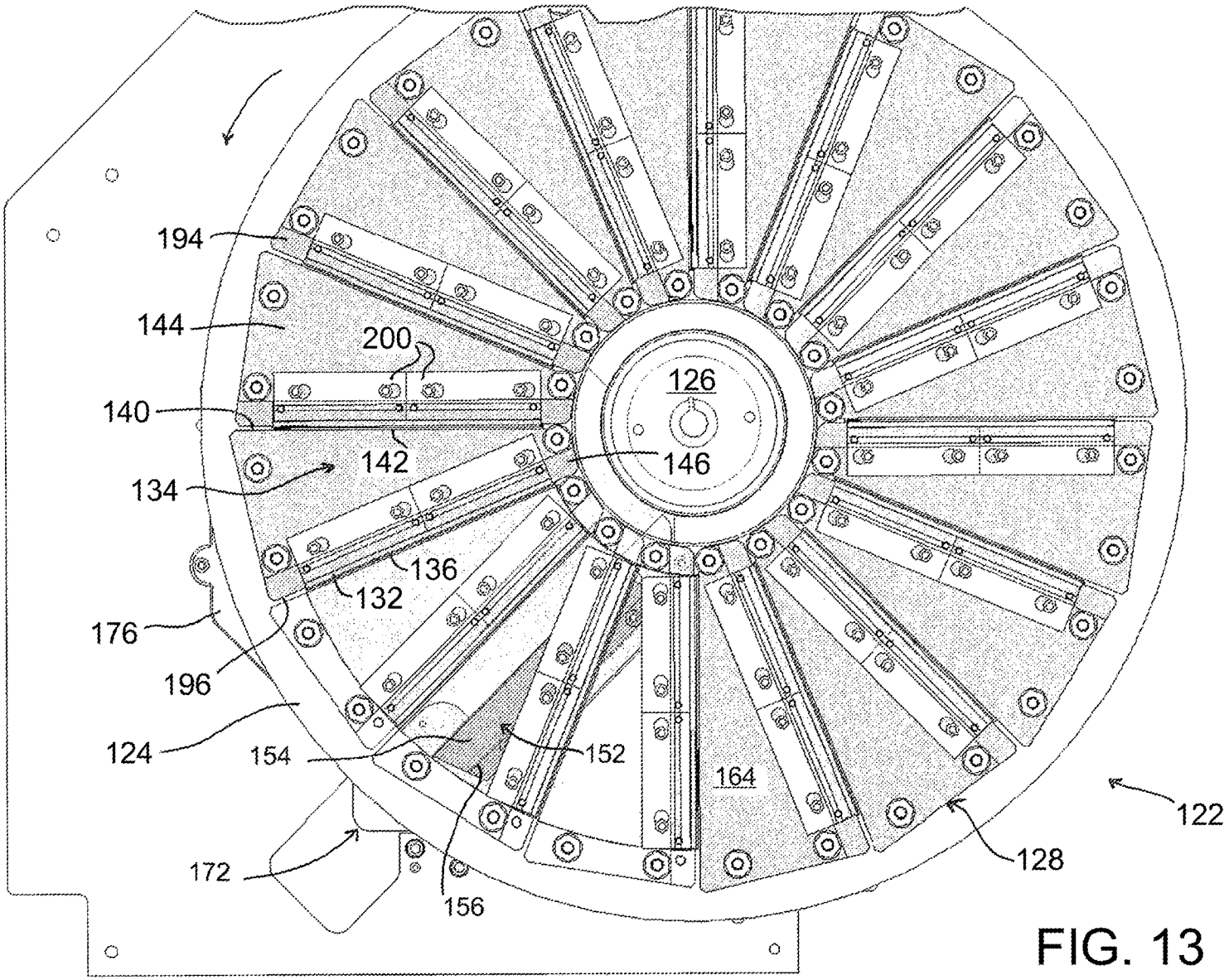
FIG. 13 is an elevation view showing the cutting wheel of FIGS. 11 and 12 mounted in a machine frame in accordance with a nonlimiting embodiment of the invention.
Figure 17:
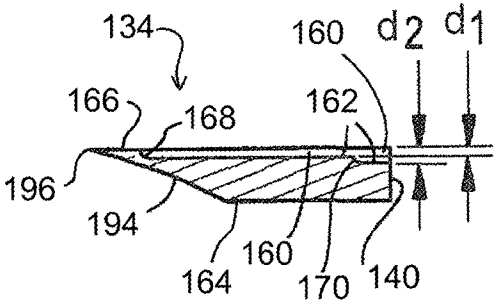
FIGS. 17 and 18 are section views taken along lines 17-17 and 18-18, respectively, in FIG. 15.
Figure 18:
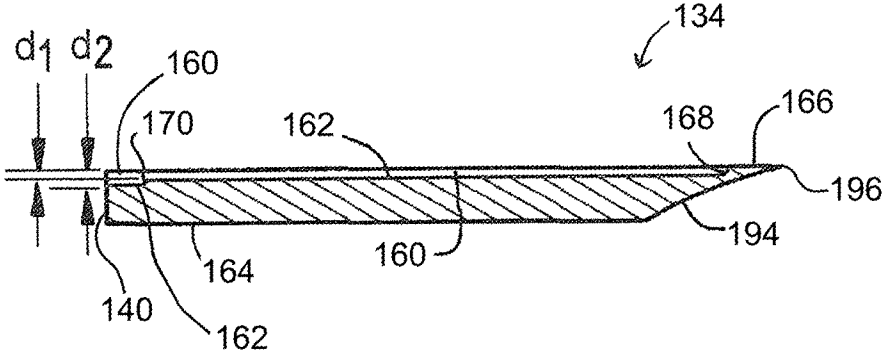
Figure 19:
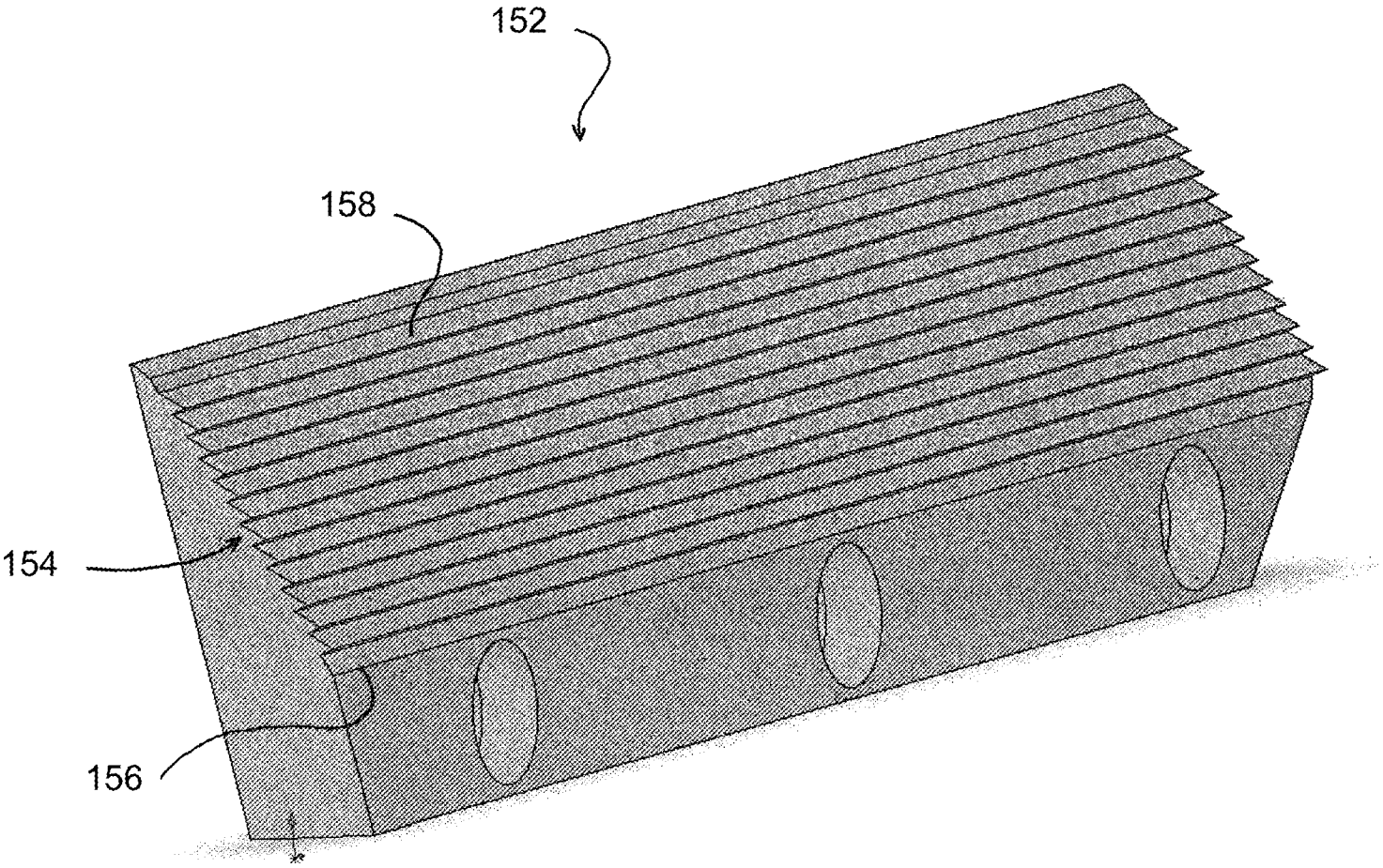
FIG. 19 is an isolated perspective view of a shear edge member depicted in FIG. 13.

FIGS. 11 through 19 represent various components and other aspects of a slicing apparatus such as of the type represented in FIGS. 1, 2 and 10. FIGS. 11 through 13 particularly show a cutting wheel 122 that is capable of use in a slicing apparatus of the type represented in FIGS. 1, 2 and 10, FIGS. 14 through 18 represent knife assemblies 128 and holders 134 of the wheel 122, and FIG. 19 represents a shear edge member 152 that is preferably, though not necessarily, used in combination with the wheel 122. The cutting wheel 122 and various components thereof are represented in FIGS. 11 through 18 as being similar in general construction to the cutting wheel 22 and components represented in FIGS. 3 through 10, and the shear edge member 152 is represented in FIG. 19 as being similar in general construction to the apron member 52 represented in FIG. 10. As such, the following discussion will focus primarily on certain aspects and features of the cutting wheel 122 and components (particularly its knife assemblies 128, and knife holders 134) and the shear edge member 152, whereas other aspects not discussed in any detail may be, in terms of structure, function, materials, etc., essentially as was described for these components in reference to FIGS. 3 through 10. In FIGS. 11 through 19, consistent reference numbers are used to identify elements that are the same or functionally equivalent to elements shown in FIGS. 3 through 10, but with the numerical prefixes "1" added.

FIGS. 11 and 13 show the side of the cutting wheel 122 that faces away from products as they approach the wheel 122, such that knife retainers or clamps 200 are visible for securing knife blades 132 to beveled surfaces 194 formed on knife holders 134 mounted to the wheel 122. FIG. 12 represents the opposite side of the cutting wheel 122, in other words, the side facing products as they approach the wheel 122. Each knife clamp 200 is mounted to a surface 164 of its knife holder 134 opposite a registration (gauging) surface 138 formed on the holder 134. As such, the surface 164 and knife clamps 200 are visible in FIGS. 11 and 13 and the registration surfaces 138 of the holders 134 are not, whereas the registration surfaces 138 are visible in FIG. 12 and the surface 164 and knife clamps 200 are not. The cutting edges 136 of the blades 132 are visible in FIGS. 11 through 13, and face the direction of rotation of the wheel 122 as indicated by the arrows. Additional components of the cutting wheel 122 include a rim portion 124 surrounding a hub portion 126, which together support the knife assemblies 128 by means of fasteners 130 so that each knife assembly 128 spans the radial distance between the rim and hub portions 124 and 126 of the cutting wheel 122. The knife holder 134 of each knife assembly 128 has a truncated triangular shape such that each holder 134 has wider and narrower ends 144 and 146, as well as trailing and leading edges 140 and 196 extending therebetween. The registration surface 138 of each holder 134 terminates at the trailing edge 140, which faces a direction opposite the direction of rotation of the wheel 122 and cooperates with the cutting edge 136 of the next adjacent trailing knife assembly 128 to define a gate 142 therebetween. The registration surface 138 and trailing edge 140 of each knife assembly 128 must be offset from the cutting edge 136 of the next adjacent trailing knife assembly 128 in a feed direction, transverse and typically perpendicular to the cutting plane of the wheel 122, such that the gate 142 therebetween defines a slice thickness gap that determines the thickness of a slice produced by the trailing knife assembly 128.

Figure 14:
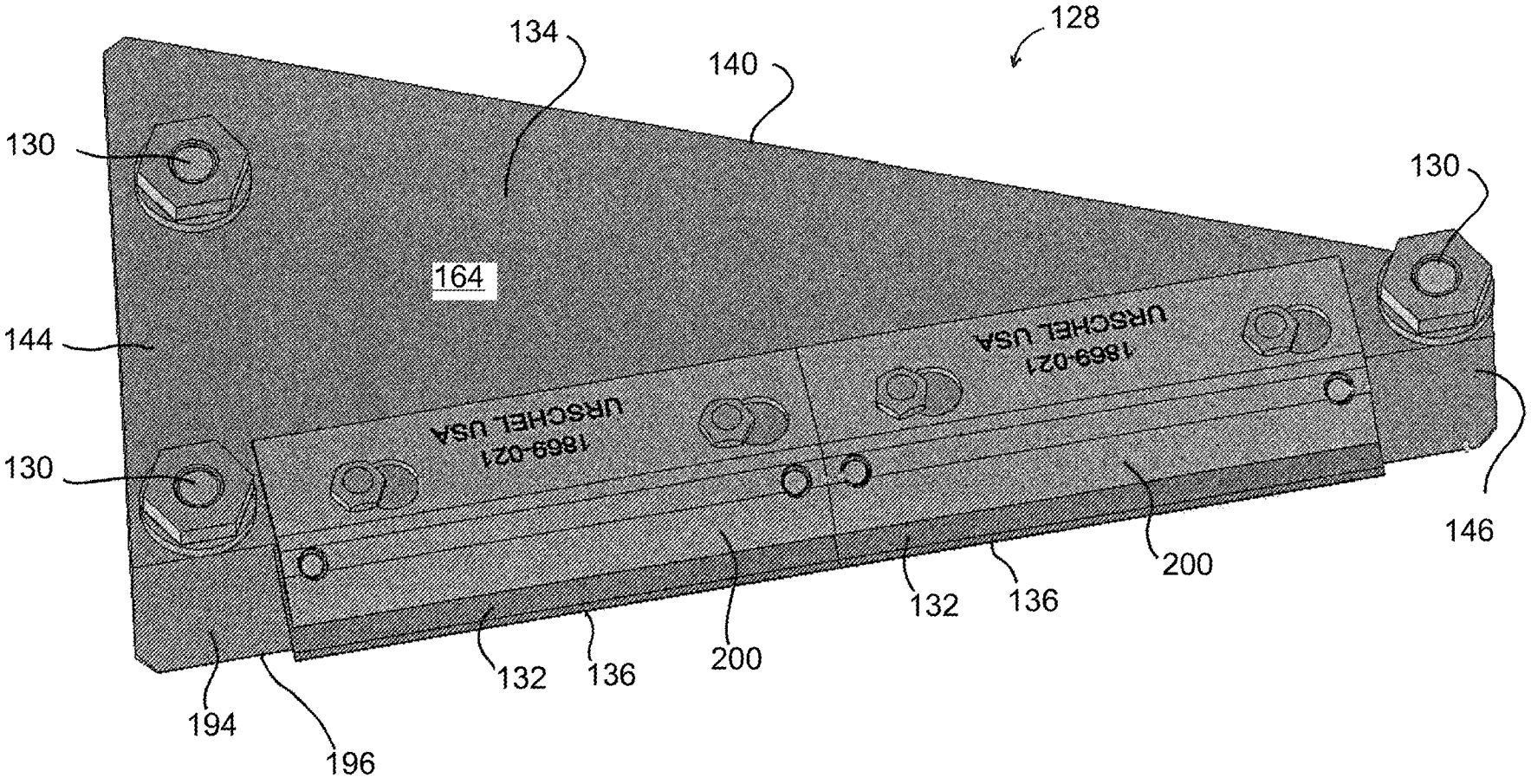
FIG. 14 is an isolated perspective view of one of the knife assemblies depicted in FIGS. 11, 12 and 13.

The cutting wheel 122 shown in FIGS. 11 through 13 is larger than the cutting wheels 10 and 22 represented in FIGS. 1 through 4, and is therefore capable and adapted to cut relatively large products, for example, food products such as cabbages, lettuce, potatoes, and meat exceeding about 10 cm in cross-section. For this reason, the knife assemblies 128 may be equipped as shown in FIGS. 11 and 13 with two knife clamps 200 to secure one or more blades 132 to each knife holder 134, for example, two blades 132 as represented in FIGS. 11, 13 and 14. However, a single knife clamp 200 may be used to secure one or more blades 132 to the knife holder 134. In the event that a blade 132 or clamp 200 must be replaced due to damage or wear, the clamping of multiple blades 132 with one or more knife clamps 200 enables selective replacement of the individual blade 132 and/or clamp 200 in a production environment. The installation of multiple blades 132 on a knife holder 134 also allows shorter blades 132 sized for installation on existing knife holders (e.g., FIGS. 3 through 9) to be installed on the longer knife holder 134.

Figure 15:
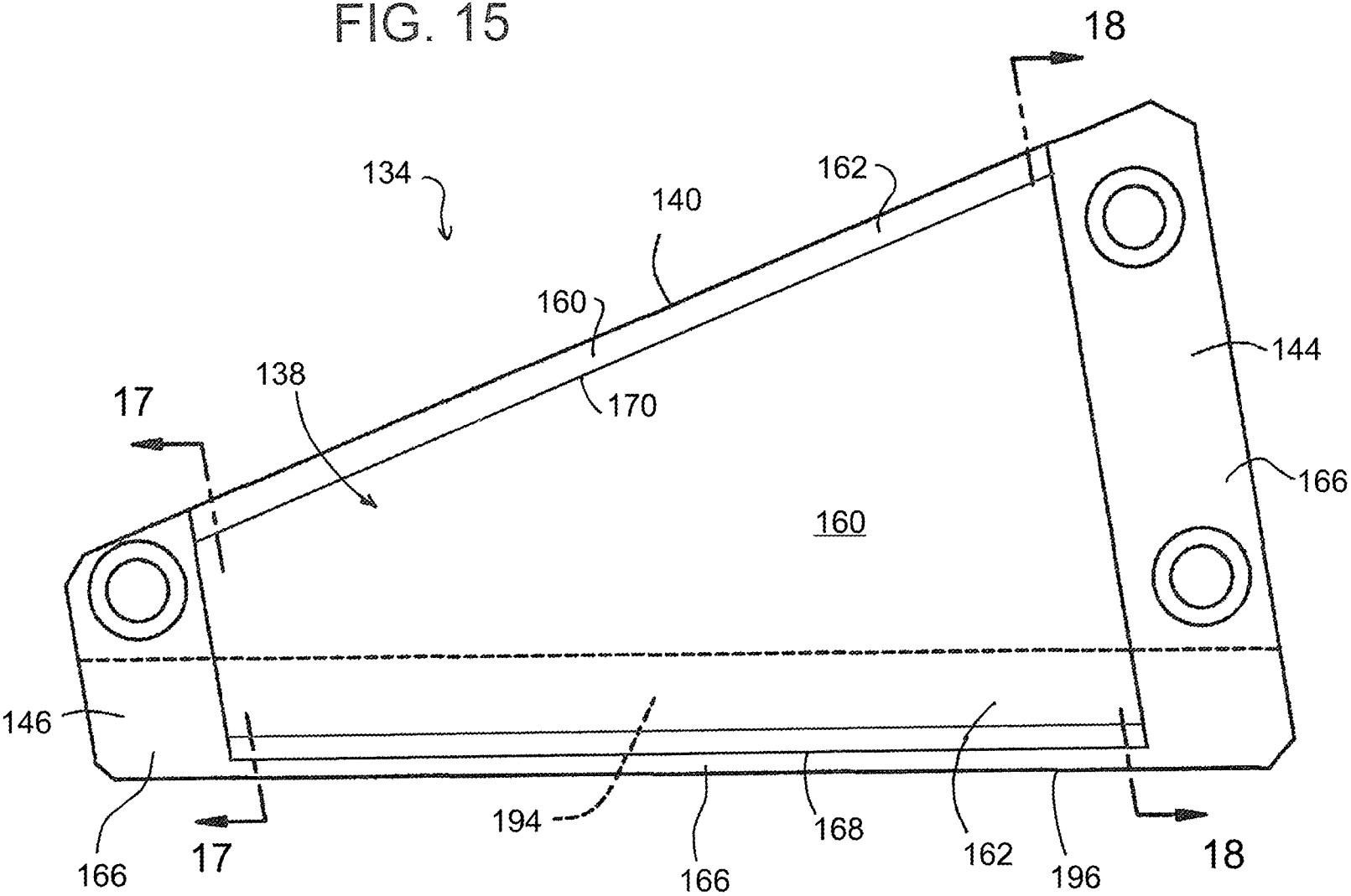
FIGS. 15 and 16 respectively show plan and edge views of a knife holder of the knife assembly of FIG. 14.
Figure 16:
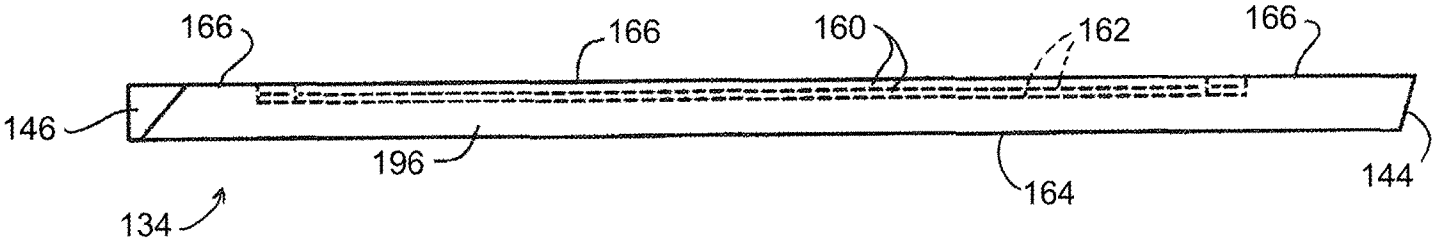

To maintain a high degree of precise slice thickness, the cutting wheel 122 and its knife assemblies 128 and knife holders 134 are configured to promote positive registration of products against the registration surface 138 (FIG. 12) of each knife assembly 128. However, the ability to maintain proper product registration is complicated by the relatively higher linear speed at the outermost radial extent of the wheel 122, which for a given rotational speed is greater than the linear speed at the outermost radial extent of the smaller wheels 10 and 22 shown in FIGS. 1 through 4. To maintain a high degree of precise slice thickness on the relatively large wheel 122 of FIGS. 11 through 13, the registration surface 138 of the knife holder 134 is not twisted or curved as described for the cutting wheel 22 of FIG. 3, but instead the registration surface 138 is defined by one or more pockets or recesses 160, each defined by a planar surface 162 instead of the curved registration surface 38 described for the knife holder 34 of FIGS. 3 through 10, whose slope progressively increased from the wider end 44 (FIGS. 6 and 7) toward the narrower end 46 (FIGS. 6 and 8) of the holder 34. In the embodiment shown in FIGS. 16 through 18, the planar surfaces 162 of the recesses 160 are approximately parallel to each other and to the oppositely-disposed surfaces 164 and 166 (each of which is preferably planar) of the knife holder 134, so that each recess 160 has a different but uniform depth ($d_1$ or $d_2$ in FIGS. 17 and 18) relative to the surface 166 of the holder 134 located on the same side of the holder 134 as the registration surface 138 (FIG. 15). Though it is within the scope of the invention that either or both surfaces 162 could slope toward the trailing edge 140, neither surface 162 is required to be curved as a consequence of having a slope that progressively increases from the wider end 144 (FIG. 18) toward the narrower end 146 (FIG. 17) of the holder 134, as was described for the knife holder 34 of FIGS. 3 through 10. Therefore, the registration surface 138 and its planar surfaces 162 are not formed by the prior practice of fixturing the knife holder 134 so that a twist is induced in the holder 134 during machining of its surface 164. As a result, the knife holder 134 can be manufactured and modified at lower manufacturing costs by allowing for the use of common fixturing to hold the knife holder 134 while being machined to generate the planar surface(s) 162 of the registration surface 138.

In the embodiment of FIGS. 15 through 18, two recesses 160 are depicted, with the recess 160 closer to the trailing edge 140 being deeper ($d_2$) than the recess 160 closer to the leading edge 196. As evident from FIG. 15, the registration surface 138 entirely extends to the trailing edge 140, such that registration surface 138 at the trailing edge 140 will be offset from the cutting edge 136 of the next adjacent trailing knife assembly 128 and the gate 142 therebetween will define the slice thickness gap that determines the thickness of a slice produced by the trailing knife assembly 128. However, the registration surface 138 is represented in FIG. 15 as approaching but short of the leading edge 196, such that a step 168 is defined between the registration surface 138 and the adjacent surface 166 of the knife holder 134 that was machined to generate the registration surface 138. In the embodiment portrayed in FIGS. 15 through 18, a second step 170 is defined between the two planar surfaces 162 of the two recesses 160. Whereas the step 168 between the registration and adjacent surfaces 138 and 166 of the knife holder 134 is parallel to the leading edge 196, the step 170 between the two planar surfaces 162 of the registration surface 138 is represented as parallel to the trailing edge 140. Either or both steps 168 and 170 may be defined by a filet, as seen in FIGS. 15, 17 and 18, or may be more abrupt. Furthermore, other orientations for the steps 168 and 170 (or single step 168 or 170) are also within the scope of the invention, and the depths ($d_1$, $d_2$) of the steps 168 and 170 and their distances from the trailing and leading edges 140 and 196 could differ from what is shown in FIGS. 15 through 18.

The configuration of the registration surface 138 of the knife holder 134 enables the depth ($d_2$) at the trailing edge 140 to be tailored to obtain a desired slice thickness, and has the further ability to permit additional machining of the holder 134 to change (increase) the original manufactured depth ($d_2$) at the trailing edge 140 to obtain a larger slice thickness, thereby enabling a knife holder 134 to be machined and even subsequently modified specifically for a certain product, while also promoting more precise registration of that product.

FIG. 13 is a fragmentary view that depicts the cutting wheel 122 mounted on a frame of a slicing machine along with a shear edge assembly 172. The shear edge assembly 172 serves to stabilize a product being fed through the wheel 122 in a feed direction transverse and typically perpendicular to the cutting plane of the wheel 122 and through the annular space between the hub 126 and rim 124. The shear edge assembly 172 is shown as being made up of a shear edge member 152 mounted to a V-shaped shear edge holder 176. The shear edge member 152 corresponds to the apron member 52 of FIG. 10. Similar to the description of FIG. 10, as unsliced products are advanced (for example, on a conveyor belt) toward the wheel 122 in a feed direction, each product is sliced by the blades 132 of the cutting wheel 122 while supported by the shear edge member 152, which has a supporting surface 154 terminating at a shear edge 156 against which the slicing action of each blade 132 occurs. Similar to what was described for the apron member 52 of FIG. 10, the shear edge member 152 represented in FIG. 13 promotes the ability with which the cutting wheel 122 is able to precisely and uniformly slice products in part as a result of its upper supporting surface 154 sloping downwardly away from products entering the wheel 122, which promotes and maintains engagement between the products and the registration surfaces 138 of the knife assemblies 128.

The shear edge 156 enables products to be wedged against the wheel 122 during slicing. For certain spherical-shaped products, for example, cabbages, lettuce, potatoes, etc., as the wheel 122 reduces the diameter of the product during slicing, the product may have a tendency to spin, which changes the slicing plane of the product as the product is being pulled into the wheel 122. To counteract this tendency, the supporting surface 154 of the shear edge member 152 is represented in FIG. 19 as having a stair-step or serrated pattern 158 that promotes the ability of the shear edge member 152 to grip and stabilize a product, such that the orientation of the product is maintained while the product is being reduced in length (in the feed direction) and the slicing plane of the product is maintained relative to the cutting plane of the wheel 122. In this manner, the supporting surface 154 is also able to maintain engagement and pressure of the product pressure against the registration surfaces 138 of the wheel 22 during the slicing process. As evident from FIG. 19, the serrated pattern 158 is defined by individual serrations or teeth, each of which is shown in FIG. 19 as inclined toward the shear edge 156 relative to the plane of the supporting surface 154. The inclination of the teeth in this manner is believed to further promote the ability of the serrated pattern 158 to grip and stabilize a product.

While the invention has been described in terms of specific or particular embodiments, it is apparent that other forms could be adopted by one skilled in the art. For example, the slicing machine, cutting wheel 122, and components thereof could differ in appearance and construction from the embodiments described herein and shown in the drawings, functions of certain components of the slicing machine and wheel 122 could be performed by components of different construction but capable of a similar (though not necessarily equivalent) function, and various materials could be used in the manufacturing of the slicing machine, wheel 122, and their components. Accordingly, it should be understood that the invention is not limited to any embodiment described herein or illustrated in the drawings. It should also be understood that the phraseology and terminology employed above are for the purpose of describing the illustrated embodiments, and do not necessarily serve as limitations to the scope of the invention. Therefore, the scope of the invention is to be limited only by the following claims.

The invention claimed is:

1. A method of manufacturing a knife holder of a rotatable cutting wheel for cutting slices from products advanced toward the cutting wheel in a feed direction, the knife holder having a truncated triangular shape that defines wider and narrower ends of the knife holder, oppositely-disposed leading and trailing edges between the wider and narrower ends, and a first surface adapted to face products advancing toward the cutting wheel in the feed direction, the method comprising:

machining the first surface of the knife holder to form a registration surface that intersects the trailing edge and is defined at least in part by a first recessed planar surface that is recessed relative to the first surface and at least in part by a second recessed planar surface that is recessed a greater distance relative to the first surface than the first recessed planar surface, and the knife holder is not twisted during the machining of the first and second recessed planar surfaces;

wherein the machining of the first surface of the knife holder forms the first surface, the first recessed planar surface, and the second recessed planar surface to be parallel to each other.

2. The method according to claim 1, wherein the machining of the first surface of the knife holder forms the second recessed planar surface to intersect the trailing edge.

3. The method according to claim 1, wherein the machining of the first surface of the knife holder forms a step between the second recessed planar surface and the first recessed planar surface.

4. The method according to claim 1, wherein the machining of the first surface of the knife holder forms the registration surface to be short of the leading edge such that an adjacent portion of the first surface is present along the leading edge and is between the registration surface and the leading edge, the registration surface is recessed relative to the adjacent portion of the first surface and defines a first step therebetween, and a portion of the first step is between the registration surface and the adjacent portion of the first surface along the leading edge.

5. The method according to claim 4, wherein the machining of the first surface of the knife holder forms a second step between the first recessed planar surface and the second recessed planar surface.

6. The method according to claim 5, wherein the machining of the first surface of the knife holder forms the first step between the registration surface and the adjacent portion of the first surface of the knife holder to be parallel to the leading edge of the knife holder and forms the second step between the first and second recessed planar surfaces to be parallel to the trailing edge.

7. The method according to claim 5, wherein the machining of the first surface of the knife holder forms the first and second steps to be defined by a filet.

8. The method according to claim 1, wherein the machining of the first surface of the knife holder uses common fixturing to hold the knife holder while forming the first and second recessed planar surfaces of the registration surface.

9. The method according to claim 1, wherein the machining of the first surface of the knife holder forms the first recessed planar surface to be wider than the second recessed planar surface.

10. The method according to claim 9, wherein the machining of the first surface of the knife holder forms the first recessed planar surface to have a truncated triangular shape that defines wider and narrower ends adjacent, respectively, the wider and narrower ends of the knife holder.

11. A method of manufacturing a knife holder of a rotatable cutting wheel for cutting slices from products advanced toward the cutting wheel in a feed direction, the knife holder having a truncated triangular shape that defines wider and narrower ends of the knife holder, oppositely-disposed leading and trailing edges between the wider and narrower ends, and a first surface adapted to face products advancing toward the cutting wheel in the feed direction, the method comprising:

machining the first surface of the knife holder to form a registration surface that intersects the trailing edge and is defined at least in part by a first recessed planar surface that is recessed relative to the first surface and at least in part by a second recessed planar surface that is recessed a greater distance relative to the first surface than the first recessed planar surface, and the knife holder is not twisted during the machining of the first and second recessed planar surfaces;

wherein the machining of the first surface of the knife holder forms the first and second recessed planar surfaces to have different but uniform depths relative to the first surface of the knife holder.

12. The method according to claim 11, wherein the machining of the first surface of the knife holder forms the first surface and the first recessed surface to be parallel to each other.

13. The method according to claim 11, wherein the machining of the first surface of the knife holder forms the registration surface to be short of the leading edge such that an adjacent portion of the first surface is present along the leading edge and is between the registration surface and the leading edge, the registration surface is recessed relative to the adjacent portion of the first surface and defines a step therebetween, and a portion of the step is between the registration surface and the adjacent portion of the first surface along the leading edge.

* * * * *